US005621306A

United States Patent [19]

Ise

[11] Patent Number: 5,621,306

[45] Date of Patent: Apr. 15, 1997

[54] TEMPERATURE COMPENSATION VOLTAGE-GENERATING CIRCUIT

[75] Inventor: Masahiro Ise, Kashihara, Japan

[73] Assignee: Sharp Kabushiki Kaisha, Osaka, Japan

[21] Appl. No.: 323,681

[22] Filed: Oct. 18, 1994

[30] Foreign Application Priority Data

Nov. 18, 1993 [JP] Japan ..... 5-289592

[51] Int. Cl.[6] ..... G05F 3/16

[52] U.S. Cl. ..... 323/313; 323/281; 323/907

[58] Field of Search ..... 323/313, 907, 323/273, 275, 280, 281, 349, 350

[56] References Cited

U.S. PATENT DOCUMENTS 4,298,835 11/1981 Rowe ..... 323/281
5,198,747 3/1993 Haight ..... 323/303
5,408,173 4/1995 Knapp ..... 323/285
5,453,678 9/1995 Bertolini et al. ..... 323/282

FOREIGN PATENT DOCUMENTS 61-141493 6/1986 Japan .
61-184004 8/1986 Japan .
1-163721 6/1989 Japan .

*Primary Examiner*—Peter S. Wong
*Assistant Examiner*—Adolf Berhane
*Attorney, Agent, or Firm*—Nixon & Vanderhye, P.C.

[57] ABSTRACT

The invention provides a voltage-generating circuit in which the characteristic of the output voltage in response to the ambient temperature is represented by a predetermined line. A temperature sensor outputs a voltage in proportion to the ambient temperature, and the voltage is inversely amplified by an operational amplifier. An optimum operating voltage $V_{op}$ for a liquid crystal is output from an output terminal of a variable voltage regulator, in response to the voltage output ted from the operational amplifier.

9 Claims, 3 Drawing Sheets

TEMPERATURE COMPENSATION VOLTAGE-GENERATING CIRCUIT

BACKGROUND OF THE INVENTION

1. Field of the Invention

The present invention relates to a temperature compensation voltage-generating circuit used for driving a liquid crystal or the like.

2. Description of the Related Art

FIG. 5 is a circuit diagram of a conventional temperature compensation voltage-generating circuit for driving a liquid crystal. Conventional voltage-generating circuits are disclosed in, for example, Japanese Unexamined Patent Publication JP-A 61-141493 (1986) and Japanese Unexamined Patent Publication JP-A 61-184004 (1986).

Liquid crystal display elements have temperature-dependent electrooptical characteristics. As the operating temperature $T_{op}$ of a liquid crystal becomes lower, the optimum operating voltage $V_{op}$ must be increased linearly, as shown in FIG. 4, to obtain a desired contrast.

An explanation of the temperature compensation voltage-generating circuit shown in FIG. 5 will now be given. An input voltage $V_{in}$ is applied to an input terminal 4 of a variable voltage regulator 1. The variable voltage regulator 1 used may be, for example, an LM317L (product of National Semiconductor, Inc.). The input terminal IN is grounded via a voltage-smoothing condenser C1. Also, the adjusting terminal 3 of the variable voltage regulator 1 is grounded via a combined resistance RX of a variable resistance R2 (resistance value is R2; hereunder the resistances will be referred to by their resistance values), a resistance R3, and a thermistor RT. The combined resistance RX is formed by connecting the thermistor RT and the resistance R3 in parallel, and connecting the variable resistance R2 in series with the group of resistances connected in parallel with each other. Thus, the resistance value of the resistance RX is represented by the following equation:

$$Rx = R2 + \frac{R3 \cdot RT}{R3 + RT} \quad (1)$$

An output terminal 2 and the adjusting terminal 3 of the variable voltage regulator 1 are connected via a resistance R1. The output terminal 2 is grounded via a voltage-smoothing condenser C2. Also, an operating voltage $V_{op}$ is outputted from the output terminal 2, and this operating voltage $V_{op}$ is supplied via a switching element, as the voltage for driving the liquid crystal.

The value of the operating voltage $V_{op}$ is represented by the following equation:

$$V_{op}=1.25\ (1+Rx/R1)+I_{ADJ}\cdot Rx \quad (2)$$

Here, the current $I_{ADJ}$ represents the value of the current flowing from the adjusting terminal 3. The value of the current $I_{adj}$ is extremely small, and thus the equation (2) approximates the following equation:

$$V_{op}\approx 1.25\ (1+Rx/R1) \quad (3)$$

wherein 1.25 is a fixed output voltage preset in the variable-Voltage regulator 1. The value of the fixed output voltage depends on the type of regulator.

Thus, according to this equation the operating voltage $V_{op}$ is basically determined by the ratio of the resistance value Rx to the resistance value R1, and thus the value of the operating voltage $V_{op}$ can be changed by adjusting the resistance value Rx.

Here, the thermistor RT has a negative resistance-temperature coefficient, and thus the resistance value increases with decrease in temperature. Consequently, since the resistance $R_x$ is represented by the equation (1), the resistance value increases with a lower temperature. Accordingly, the operating voltage $V_{op}$ also increases with a lower temperature.

The resistance-temperature characteristic of the resistance value of the thermistor RT is represented by the following equation:

$$RT=RO\cdot\exp(B(1/T-1/TO)) \quad (4)$$

RO: Resistance value of thermistor at standard temperature TO.

B: Constant

T: Ambient temperature

Consequently, as shown by the equation (4), the characteristic is represented by a non-linear and exponential function; therefore, the operating voltage $V_{op}$ represented by the equation (3) cannot be precisely matched with the optimum operating voltage $V_{op}$ in response to the operating temperature $T_{op}$ of the liquid crystal which changes linearly as shown in FIG. 4, and further the combination of the resistance value RO and the constant B in the equation (4) is in a limited range of values. Therefore it is a major problem to decide how closely to approach the characteristics shown in FIG. 4 by appropriate selection of R1, R2 and R3, and thus it is not always possible to achieve a satisfactory level.

SUMMARY OF THE INVENTION

An object of the present invention is to provide a temperature compensation voltage-generating circuit with a characteristic of output voltage in response to the ambient temperature which is represented by a predetermined line.

The present invention relates to a temperature compensation voltage-generating circuit for supplying an operating voltage to a load such that an optimum operating voltage varies linearly with change in temperature, the circuit comprising:

a temperature-detecting element whose output changes linearly in response to the temperature;

a voltage regulator with a control terminal, which outputs an output voltage in response to an electrical signal revel fed to the control terminal;

amplification means to which is fed the output from the temperature-detecting element and which amplifies at a gain set so as to vary the output voltage of the voltage regulator with a predetermined gradient; and level setting means for adjusting the output level from the amplification means and feeding the adjusted output level to the control terminal of the voltage regulator.

According to the invention, the output from the temperature-detecting element changes linearly in response to the change of temperature. The: voltage regulator has a control terminal, and outputs to the load an output voltage corresponding to the electrical signal level fed to the control terminal. The output from the temperature-detecting means is fed to the amplification means, which amplifies at a gain set so as to vary the output voltage of the voltage regulator with a predetermined gradient. The level setting means adjusts the output level from the amplifier and feeds the adjusted output level to the control terminal of the voltage regulator.

Consequently, it is possible to obtain a circuit which generates a temperature compensation voltage, wherein the characteristic of the output voltage of the voltage regulator in response to the ambient temperature matches a predetermined line.

According to the invention, it is possible to obtain a temperature compensation voltage-generating circuit whose output voltage characteristic in response to the ambient temperature is represented by a predetermined line.

The invention is characterized in that the output of the temperature-detecting element linearly increases in response to increase in temperature.

The invention is characterized in that the amplification means comprises an operational amplifier to whose negative terminal is fed the output of the temperature-detecting element, a first resistance element which is interposed between the negative terminal and an output terminal of the temperature-detecting element, and a second resistance element which is connected between the negative terminal and an output terminal of the operational amplifier.

The invention is characterized in that the second resistance element is a variable resistance element.

The invention is characterized in that the load is such that the optimum operating voltage linearly decreases with increase in temperature.

The invention is characterized in that the load is a liquid crystal.

The invention is characterized in that the level setting means comprises a third resistance element interposed between the output terminal of the amplification means and the control terminal of the voltage regulator and a fourth resistance element connected between the output terminal and control terminal of the voltage regulator.

The invention is characterized in that the third resistance element is a variable resistance element.

The invention is characterized in that a voltage smoothing condenser is connected to at least one of the input terminal and output terminal of the voltage regulator.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
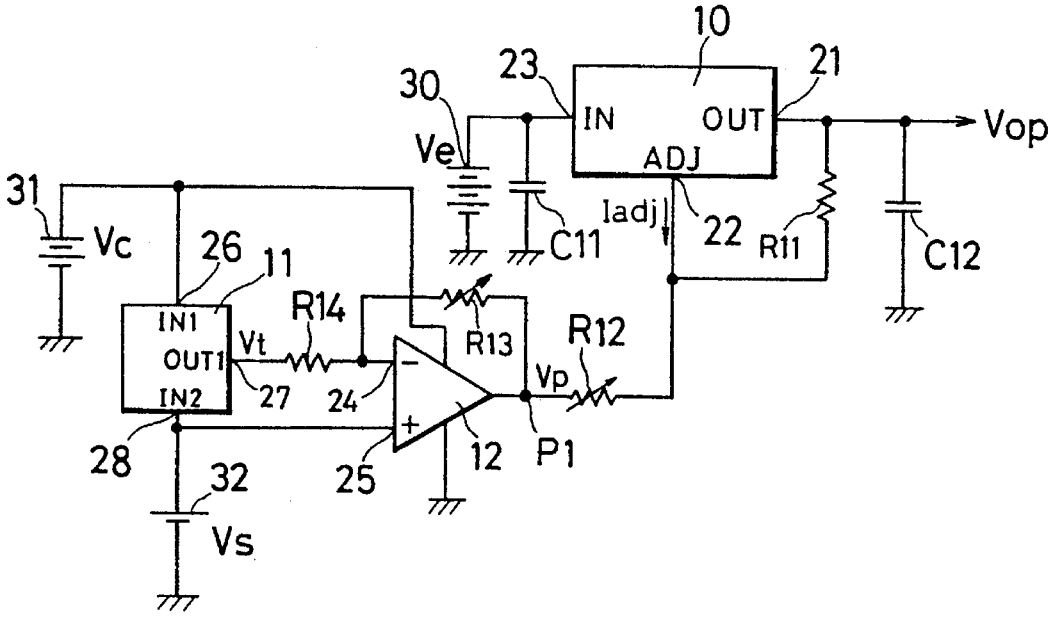
FIG. 1 is a circuit diagram showing an embodiment of a temperature compensation voltage-generating circuit according to the invention.

Now referring to the drawings, preferred embodiments of the invention are described below.

FIG. 1 is a circuit diagram showing a temperature compensation voltage-generating circuit for a liquid crystal of an embodiment of the invention. The liquid crystal used may be a super/twisted/nematic/duty liquid crystal (ZLI336, product of Merck Co.). The input voltage $V_e$ of a power source 30 is inputted to an input terminal 23 of a variable voltage regulator 10. The variable voltage regulator 10 used may be, for example, an LM317L (product of National Semiconductor, Inc.). The LM317L, although it is no different from conventional three-terminal regulators in performance, has a fixed relatively low output voltage $V_r$ of 1.25 V. The input terminal 23 is grounded via a voltage-smoothing condenser C11. Also, the adjusting terminal 22 of the variable voltage regulator 10 is connected with a connection point P1 via a variable resistor R12. An output terminal 21 and the adjusting terminal 22 of the variable voltage regulator 10 are connected via a resistor R11. The output terminal 21 is grounded via a voltage-smoothing condenser C12.

When the voltage at the connection point P1 is Vp, the operating voltage $V_{op}$ is represented by the following equation:

$$V_{op}=1.25\ (1+R12/R11)+I_{adj}\cdot R12+V_p \tag{5}$$

Here, the current $I_{adj}$ represents the value of the current flowing from the adjusting terminal 22 and 1.25 is a fixed output voltage preset in the variable voltage regulator 10. The value of the fixed output voltage depends on the type of regulator. Equation (5) is derived on the basis of the operation for maintaining the potential difference between the operation voltage $V_{op}$ and the voltage of the adjusting terminal 22 to be the fixed output voltage $V_r$. Since Current flowing in the resistance R11=$V_r$/R11, and Current flowing in the resistance R12=$V_r$/R11+$I_{adj}$ and Voltage at the connection point $P1 = V_p$, $$\begin{aligned} V_{op} &= \text{(voltages at both ends of the resistance } R11) + \\ &\quad \text{(voltages at both ends of the resistance } R12) + V_p \\ &= V_r + R12(V_r/R11 + I_{adj}) + V_p \\ &= V_r(1 + R12/R11) + I_{adj}\cdot R12 + V_p. \end{aligned}$$

The value of the current Iadj is extremely small $I_{adj}$=100 μA, and thus the equation (5) approximates the Equation 6. The current $I_{adj}$ is decided in relation to the current flowing in the resistance R11. More specifically, in order to realize an stable operation, the current flowing in the resistance R11 should be set to be >>$I_{adj}$. This is because: the effect of the current $I_{adj}$ due to variation in temperature should be eliminated.

$$V_{op}\approx 1.25\ (1+R12/R11)+V_p \tag{6}$$

According to Equation 6, the value of the output voltage $V_{op}$ can be changed by adjusting the resistance value of the variable resistance R12. Although the output voltage $V_{op}$ may be changed by changing the resistance value of the resistance R11, it is desirable to maintain the current flowing in the resistance R11 constant in order to avoid unnecessary output variation and the resistance R12 is made variable in order to avoid the possibility of the short circuit of the resistance R11.

Figure 2:
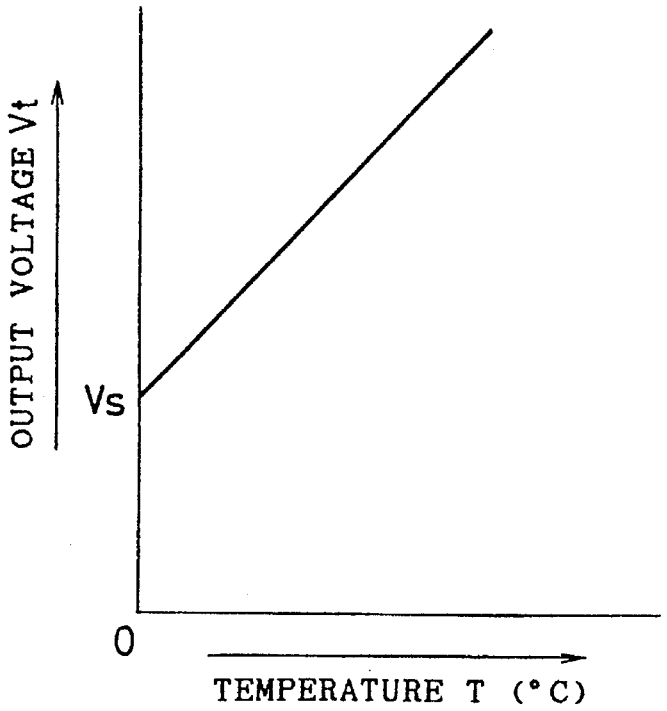
FIG. 2 is a graph showing the output voltage characteristic of a temperature sensor.

The circuit of FIG. 1 includes a temperature sensor 11, for example, an LM35 (National Semiconductor, Inc.) or the like. The voltage $V_c$ of a power source 31 is inputted to an input terminal 26 of temperature sensor 11. The voltage Vs of an offset power source 32 is inputted to an input terminal 28 of the temperature sensor 11. The characteristic of the output voltage of the temperature sensor 11 in response to the ambient temperature is represented by a line with a positive gradient, as shown FIG. 2. Consequently, the output voltage Vt outputted from an output terminal 27 of the temperature sensor 11 is represented by the following equation:

$$\text{Output voltage } V_t = V_s + K \cdot T \quad (7)$$

K: temperature coefficient of temperature sensor 11 (V/°C) (=10 mV/°C.)

T: Ambient temperature

An output voltage $V_t$ from the temperature sensor 11 is inputted to a negative terminal 24 of an operational amplifier 12 via a resistance R14, and the voltage Vs is inputted to a positive terminal 25 of the operational amplifier 12. The voltage $V_c$ from the power source 31 is fed to the power source terminal the operational amplifier 12. Via a variable resistance R13, the negative terminal 24 of the operational amplifier 12 is connected with the connection point P1 which is connected with the output terminal of the operational amplifier 12. Consequently, the operational amplifier 12 and the resistances R13, R14 constitute an inverted, amplifier, and the voltage $V_p$ at the connection point P1 is represented by the following equation:

$$Vp = Vs - (R13/R14) \cdot (V_t - V_s) \quad (8)$$

and combining equations (7) and (8), $$Vp = Vs - (R13/R14) \cdot K \cdot T \quad (9)$$

Consequently, the operating voltage $V_{op}$ may be calculated by the following equation, into which the equations (6), (9) are combined.

$$V_{op} \approx 1.25\ (1 + R12/R11) + V_s - (R13/R14) \cdot K \cdot T \quad (10)$$

Figure 3:
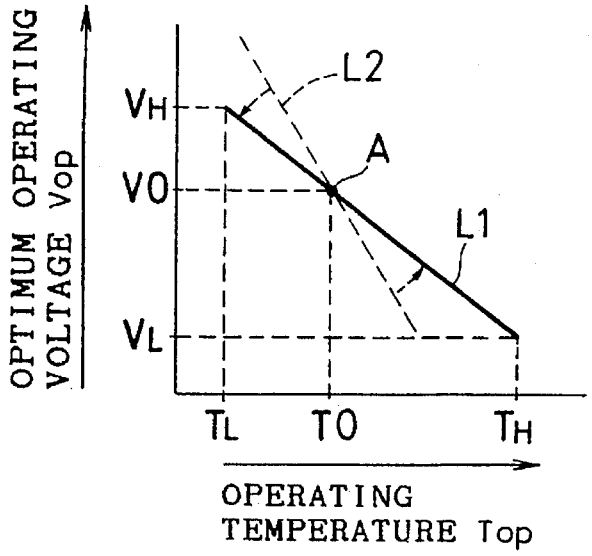
FIG. 3 is a graph showing the characteristic of the optimum operating voltage $V_{op}$ corresponding to the operating temperature $T_{op}$ of a liquid crystal.
Figure 4:
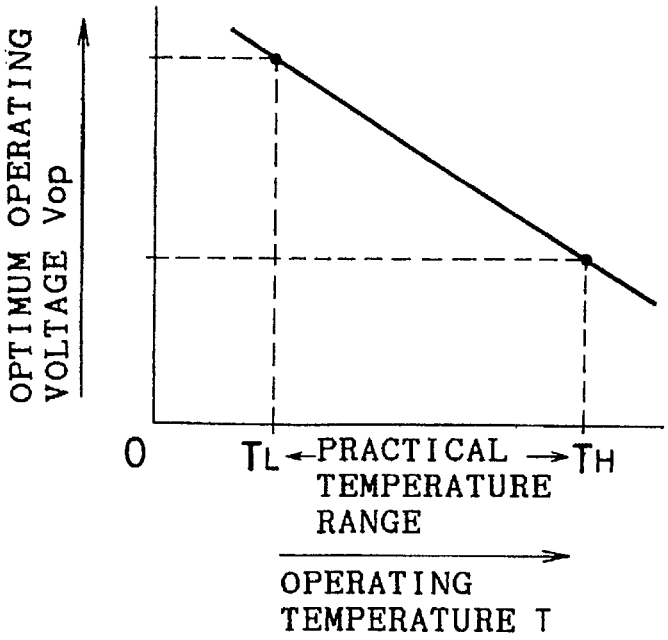
FIG. 4 is a graph showing the characteristic of the optimum operating voltage $V_{op}$ corresponding to the operating temperature $T_{op}$ of a liquid crystal.
Figure 5:
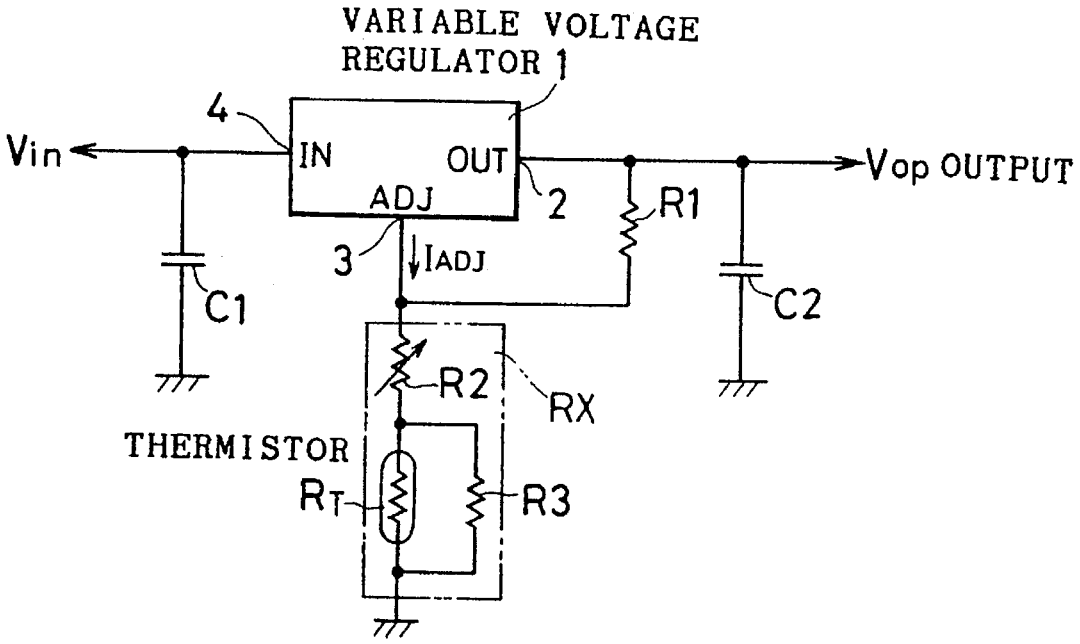
FIG. 5 PRIOR ART
FIG. 5 is a circuit diagram showing a conventional temperature compensation voltage-generating circuit.

The characteristic of the optimum operating voltage $V_{op}$ corresponding to the operating temperature $T_{op}$ of the liquid crystal is represented by a line L1 with a negative gradient, as shown in FIG. 3. Therefore, because the temperature characteristic of the operating voltage $V_{op}$ of the voltage-generating circuit represented by the equation (10) must be matched to the line L1 shown in FIG. 3 which represents the temperature characteristic of the optimum operating voltage $V_{op}$, the following adjustment is made. First, the value of the operating voltage $V_{op}$ represented by equation (10) is set to V0 by adjusting the resistance value of the variable resistance R12 at the determined ambient temperature T0 shown in FIG. 3. Thus, the temperature characteristic of the operating voltage $V_{op}$ represented by the equation (10) is shown by a line L2 passing through point A shown in FIG. 3. Next, the resistance values R13, R14 of the operating voltage $V_{op}$ represented by equation (10) are adjusted to match the gradient of the line L2 representing the characteristic of the operating voltage $V_{op}$, with the gradient of the line L1 shown in FIG. 3. Thus it is possible to match the Line L1 signifying the characteristic of the operating voltage $V_{op}$ represented by equation (10) with the line L2 shown in FIG. 3. Additionally, when the resistances R13, R14 are adjusted, from a view of maintaining the load current of the temperature sensor 11 constant, it is preferable to fix the resistance value of the resistance R14 and change the resistance value of the resistance R13.

In the graph in FIG. 3, the practical temperature range TL–TH is 0° C. to 60° C. The output voltage characteristic of the temperature sensor 11 in response to temperatures in this range is linearly represented, the amplification factor R13/R14 of the operational amplifier 12 is constant. Consequently, the temperature characteristic L2 (=L1) of the operating voltage $V_{op}$ of the voltage adjusting circuit represented by the equation (10) in the practical temperature range (TL–TH) is shown by the graph in FIG. 3. To obtain the characteristic of the graph in FIG. 3 in the practical temperature range (TL–TH), it is necessary to satisfy the relationship $V_s \geqq VH - VL$.

When $TL \geqq 0$, the operating voltage $V_{op}$ changes almost linearly in this range. Based on the equation (10), $$VH - VL = (R13/R14) \cdot K \cdot (TH - TL) \leqq (R13/R14) \cdot K \cdot TH \quad (11)$$

Additionally, if $V_p$ is not-zero or more, the output voltage of the operational amplifier 12 is not correctly outputted. Consequently, based on the equation (9), $$V_p = V_s - (R13/R14) \cdot K \cdot TH \geqq 0 \quad (12)$$

From the equations (11), (12), following relationship derived:

$$V_s \geqq VH - VL$$

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended robe embraced therein.

What is claimed is:

1. A temperature compensation voltage-generating circuit for supplying an operating voltage to a load such that an optimum operating voltage varies linearly with change in temperature, the circuit comprising:

a temperature sensor whose output changes linearly in response to the temperature;

a voltage regulator with a control terminal, which outputs an output voltage in response to an electrical signal level fed to the control terminal;

an amplification network which receives the output from the temperature sensor and which amplifies at a gain set so as to vary the output voltage of the voltage regulator with a predetermined gradient, the amplification network comprising:

an operational amplifier whose negative terminal receives the output of the temperature sensor, a first resistance element which is interposed between the negative terminal and an output terminal of the temperature sensor, and a second resistance element which is connected between the negative terminal and an output terminal of the operational amplifier; and a level setting network for adjusting an output level from the amplification network and feeding the adjusted output level to the control terminal of the voltage regulator.

2. The circuit of claim 1, wherein the output of the temperature sensor linearly increases in response to increase in temperature.

3. The circuit of claim 1, wherein the second resistance element )s a variable resistance element.

4. The circuit of claim 1, wherein the load is such that the optimum operating voltage linearly decreases with increase in temperature.

5. The circuit of claim 4, wherein the load is a liquid crystal.

6. The circuit of claim 1, wherein a voltage smoothing condenser is connected to at least one of the input terminal and output terminal of the voltage regulator.

7. A temperature compensation voltage-generating circuit for supplying an operating voltage to a load such that an optimum operating voltage varies linearly with change in temperature, the circuit comprising;

a temperature sensor whose output changes linearly in response to the temperature;

a voltage regulator with a control terminal, which outputs an output voltage in response to an electrical signal level fed to the control terminal;

an amplification network which receives the output from the temperature sensor and which amplifies at a gain set so as to vary the output voltage of the voltage regulator with a predetermined gradient;

a level setting network for adjusting an output level from the amplification network and feeding the adjusted output level to the control terminal of the voltage regulator;

wherein the level setting network comprises:

a resistance element interposed between the output terminal of the amplification network and the control terminal of the voltage regulator, and a resistance element connected between the output terminal and control terminal of the voltage regulator.

8. The circuit of claim 7, wherein the resistance element interposed between the output terminal of the amplification network and the control terminal of the voltage regulator is a variable resistance element.

9. The circuit of claim 7, wherein the amplification network comprises:

an operational amplifier whose negative terminal receives the output of the temperature sensor, a first resistance element which is interposed between the negative terminal and an output terminal of the temperature sensor, and a second resistance element which is connected between the negative terminal and an output terminal of the operational amplifier.

* * * * *